US008523178B2

(12) United States Patent
Tanaka

(10) Patent No.: US 8,523,178 B2
(45) Date of Patent: Sep. 3, 2013

(54) DISCHARGE MECHANISM AND IMAGE FORMING DEVICE

(75) Inventor: Yasuki Tanaka, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 310 days.

(21) Appl. No.: 12/636,116

(22) Filed: Dec. 11, 2009

(65) Prior Publication Data

US 2010/0232856 A1 Sep. 16, 2010

(30) Foreign Application Priority Data

Mar. 13, 2009 (JP) ..... 2009-061186

(51) Int. Cl.
*B65H 5/16* (2006.01)

(52) U.S. Cl.
CPC ..... *B65H 5/16* (2013.01)
USPC ..... 271/271; 271/2; 464/179

(58) Field of Classification Search
USPC ..... 271/271, 306, 2; 492/39
See application file for complete search history.

(56) References Cited

U.S. PATENT DOCUMENTS

| | | | | |
|---|---|---|---|---|
| 3,981,496 | A * | 9/1976 | Jensen et al. | 271/314 |
| 3,991,996 | A * | 11/1976 | Bass | 271/314 |
| 4,988,087 | A * | 1/1991 | Sardano et al. | 271/314 |
| 5,215,394 | A * | 6/1993 | Kim | 271/207 |
| 6,488,279 | B1 * | 12/2002 | Fukuda et al. | 271/314 |
| 6,666,448 | B2 * | 12/2003 | Sato et al. | 271/177 |
| 6,722,651 | B2 * | 4/2004 | Fujisawa et al. | 271/207 |
| 7,431,289 | B2 * | 10/2008 | Sekiyama et al. | 271/188 |
| 7,513,498 | B2 * | 4/2009 | Elenes et al. | 271/314 |
| 7,681,880 | B2 * | 3/2010 | Sekiyama et al. | 271/209 |
| 8,333,378 | B2 * | 12/2012 | Miyazaki et al. | 271/314 |
| 2004/0234318 | A1 | 11/2004 | Noda et al. | |
| 2005/0068401 | A1 * | 3/2005 | Aoki | 347/104 |
| 2005/0179193 | A1 * | 8/2005 | Elenes | 271/119 |
| 2005/0221967 | A1 * | 10/2005 | Noda et al. | 492/39 |

FOREIGN PATENT DOCUMENTS

| | | | |
|---|---|---|---|
| CN | 1453139 | A | 11/2003 |
| JP | 59-153953 | | 10/1984 |
| JP | 04133936 | A * | 5/1992 |
| JP | 5-39156 | | 2/1993 |
| JP | 5-221570 | | 8/1993 |
| JP | 6-14166 | U | 2/1994 |
| JP | 6-76240 | U | 10/1994 |
| JP | 08-244995 | | 9/1996 |
| JP | 08244995 | A * | 9/1996 |
| JP | 9-169463 | | 6/1997 |
| JP | 2002-274725 | | 9/2002 |

OTHER PUBLICATIONS

SIPO: First Office Action for Chinese Patent Application No. 200910261520.7—Issued on Jun. 25, 2013—Including English Translation of First Notification of Office Action and Text of the First Office Action.

* cited by examiner

*Primary Examiner* — Gerald McClain
(74) *Attorney, Agent, or Firm* — Morgan, Lewis & Bockius LLP

(57) ABSTRACT

A discharge mechanism includes a rotating shaft that is rotatable, a plurality of roll portions provided around the rotating shaft, an opposing member provided above the roll portions so as to oppose the roll portions, the opposing member holding and conveying a material to be conveyed, in cooperation with the roll portions so that the material to be conveyed is discharged onto a discharge section, and a protrusion formed on an outer periphery of the rotating shaft, the protrusion not protruding beyond the outer diameter of the roll portions.

9 Claims, 15 Drawing Sheets

DISCHARGE MECHANISM AND IMAGE FORMING DEVICE

CROSS-REFERENCE TO RELATED APPLICATION

This application is based on and claims priority under 35 USC 119 from Japanese Patent Application No. 2009-061186 filed on Mar. 13, 2009.

BACKGROUND

Technical Field

The present invention relates to a discharge mechanism and an image forming device.

SUMMARY

A first aspect of the present invention is a discharge mechanism including: a rotating shaft that is rotatable; plural roll portions provided around the rotating shaft; an opposing member provided above the roll portions so as to oppose the roll portions, the opposing member holding and conveying a material to be conveyed, in cooperation with the roll portions so that the material to be conveyed is discharged onto a discharge section; and a protrusion formed on an outer periphery of the rotating shaft, the protrusion not protruding beyond the outer diameter of the roll portions.

BRIEF DESCRIPTION OF THE DRAWINGS

Exemplary embodiments of the present invention will be described in detail based on the following figures, wherein.

DETAILED DESCRIPTION

An exemplary embodiment relating to the invention will be described on the basis of the drawings.

Figure 1:
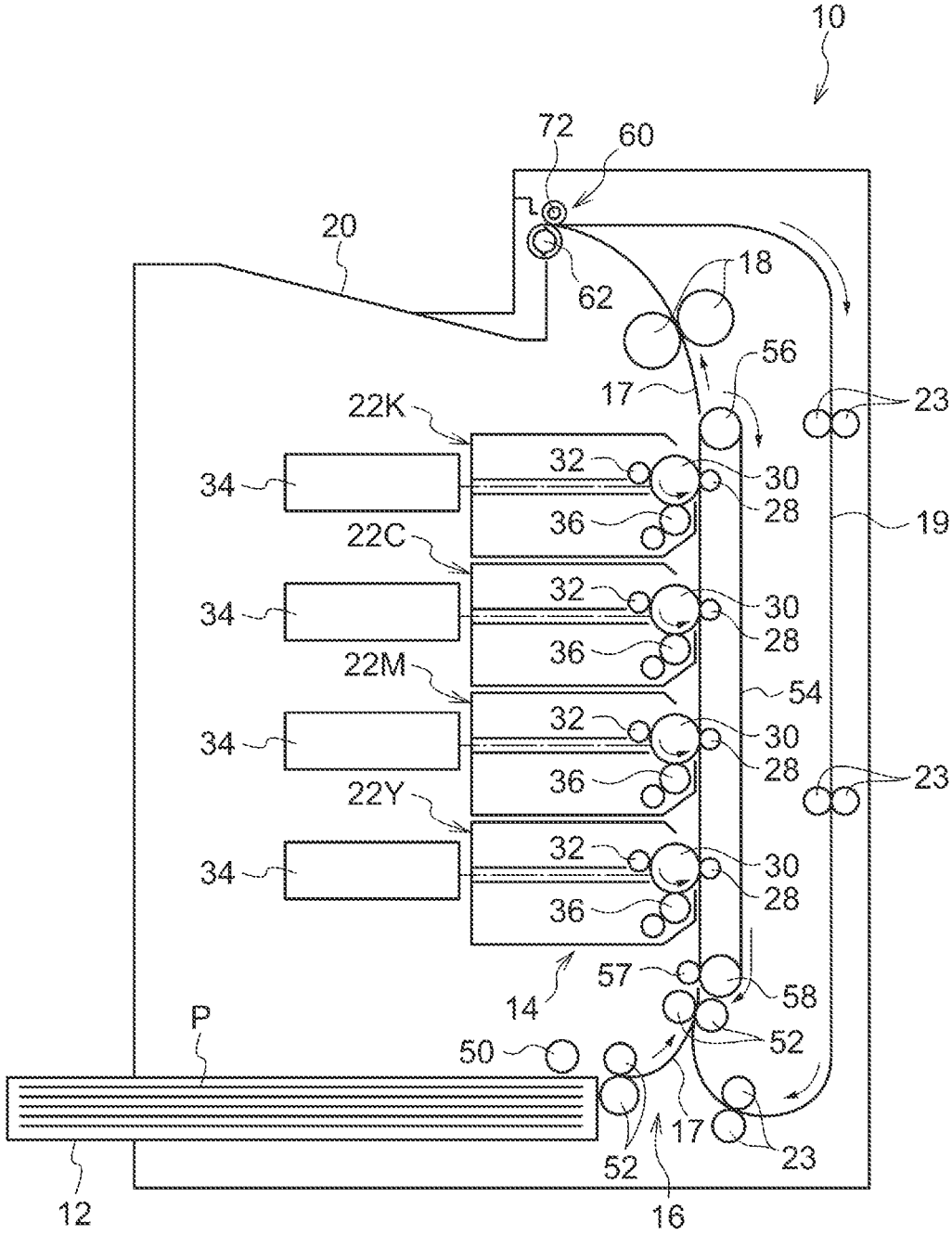
FIG. 1 is a schematic view showing the structure of an image forming device relating to the present exemplary embodiment.

Structure of Image Forming Device Relating to the Present Exemplary Embodiment First, the structure of an image forming device relating to the present exemplary embodiment will be described. FIG. 1 is a schematic view showing the structure of the image forming device relating to the present exemplary embodiment.

As shown in FIG. 1, an image forming device 10 includes a recording medium accommodating section 12, an image forming section 14, a conveying section 16 and a recording medium discharge section 20. A recording medium P, which is shown as an example of materials to be conveyed, is accommodated in the recording medium accommodating section 12. In the image forming section 14, an image is formed on a recording surface of the recording medium P. The conveying section 16 conveys the recording medium P from the recording medium accommodating section 12 to the image forming section 14. The recording medium P having the image formed thereon by the image forming section 14 is discharged from the recording medium discharge section 20. Examples of the recording medium P include paper, films formed of plastics and metals, and the like.

The image forming section 14 includes: image forming units 22Y, 22M, 22C and 22K that form toner images of yellow (Y), magenta (M), cyan (C) and black (K), respectively; transfer members 28 that transfer the toner images formed in the image forming units 22Y, 22M, 22C and 22K to the recording surface of the recording medium P; and a fixing device 18 that fixes on the recording medium P the toner images that have been transferred by the transfer members 28.

The image forming units 22Y, 22M, 22C and 22K respectively have a photoreceptor drum 30 that rotates in a certain direction (a counterclockwise direction in FIG. 1). The photoreceptor drum 30 is an example of an image holding body holding the toner image that has been formed on the surface of the recording medium P.

A charging device 32 that charges a surface of the photoreceptor drum 30, an exposure device 34 that exposes the surface of the photoreceptor drum 30 to form an electrostatic latent image thereon, and a developing device 36 that develops the electrostatic latent image formed on the surface of the photoreceptor drum 30 to form a toner image are provided around each of the photoreceptor drums 30 in this order from an upstream side in a direction of rotation of the photoreceptor drum 30.

The transfer member 28 faces the photoreceptor drum 30 across a conveying belt 54, which will be described below. A transfer position, at which the toner image on the surface of the photoreceptor surface 30 is transferred onto the recording medium P, is formed between the transfer member 28 and the photoreceptor drum 30. At this transfer position, the transfer member 28 transfers the toner image on the surface of the photoreceptor drum 30 onto the recording medium P by contact pressure and electrostatic force.

The conveying section 16 includes a feed roller 50 that feeds the recording medium P accommodated in the recording medium accommodating section 12, pairs of conveying rollers 52 that hold therebetween and convey the recording medium P that has been fed by the feed roller 50, and the conveying belt 54 that is an example of a conveying body and conveys to the transfer position the recording medium P that has been conveyed by the pairs of conveying rollers 52.

The feed roller 50, the pairs of conveying rollers 52 and the conveying belt 54 are disposed in this order along a first conveying path 17 extending from the recording medium accommodating section 12 toward the recording medium discharge section 20.

The conveying belt 54 is formed in a loop around entrainment rollers 56 and 58. The entrainment roller 56 is circular and disposed at a downstream side in a direction in which the recording medium P is conveyed (hereinafter referred to as "the conveying direction of the recording medium P" or simply "the conveying direction"). The entrainment roller 58 is disposed at an upstream side in the conveying direction of the recording medium P. The conveying belt 54 is structured so as to be rotated (driven in cycles) in a certain direction (a clockwise direction in FIG. 1) by either one of the entrainment rollers 56 and 58 being driven to rotate in a certain direction (the clockwise direction in FIG. 1).

A charging roller 57 is provided adjacent to the conveying belt 54 and at the upstream side thereof in the conveying direction. The charging roller 57 charges the surface of the conveying belt 54 and presses, against the conveying belt 54, the recording medium P that is electrostatically attracted to the conveying belt 54.

The conveying belt 54 is not limited to that structured so as to electrostatically attract and hold the recording medium P, and may be structured so as to hold the recording medium P by non-electrostatic devices such as suction or adhesion.

The fixing device 18 is disposed downstream of the transfer positions in the conveying direction and fixes, on the recording medium P, the toner images that have been transferred onto the recording medium P at the transfer positions.

Downstream of the fixing device 18 in the conveying direction is disposed a discharge mechanism 60 that discharges, to the recording medium discharge section 20, the recording medium P having the toner images fixed thereon by the fixing device 18. The discharge mechanism 60 is formed so as to discharge the recording medium P to the recording medium discharge section 20 with the recording surface facing down. The structure of the discharge mechanism 60 will be described later.

Further, a second conveying path 19, which inverts the recording medium P having an image formed on one side thereof back into the first conveying path 17, is disposed so as to face the first conveying path 17 across the conveying belt 54.

Plural pairs of conveying rollers 23 for holding therebetween and conveying the recording medium P are disposed at the second conveying path 19. When images are formed on both sides of the recording medium P, the recording medium P with an image formed on one side thereof is redirected to the second conveying path 19 by the discharge mechanism 60 and conveyed downstream and back to the first conveying path 17 by the plural pairs of conveying rollers 23.

In the image forming device 10 relating to the present exemplary embodiment having the above-described structure, first, the recording medium P that has been fed from the recording medium accommodating section 12 is sequentially fed into the transfer positions corresponding to the respective colors of yellow, magenta, cyan and black by the conveying belt 54.

The toner images of the respective colors formed on the photoreceptor drums 30 are transferred by the transfer members 28 onto the recording medium P that is fed to the transfer positions, and are superposed to form a color image on the recording medium P. The recording medium P is further conveyed to the fixing device 18 where the transferred toner images are fixed. When an image is formed on only one side of the recording medium P, the recording medium P is discharged to the recording medium discharge section 20 by the discharge mechanism 60 after the toner images are fixed. At this time, the recording medium P is discharged out to the recording medium discharge section 20 with the recording surface having the image formed thereon facing down.

When images are formed on both sides of the recording medium P, after an image is formed on one side thereof, the recording medium P is inverted and redirected to the second conveying path 19 by the discharge mechanism 60. The recording medium P is further fed from the second conveying path 19 back into the first conveying path 17, where an image is formed on the opposite side in the same way as described above, whereby the images are formed on both sides of the recording medium P. The series of image forming processes are carried out as described above.

Note that the structure of the image forming device is not limited to that described above. For example, the image forming device may be of indirect transfer type having an intermediate transfer body. Various structures are possible for the image forming device.

Structure of Discharge Mechanism 60 Relating to Present Exemplary Embodiment

Figure 2:
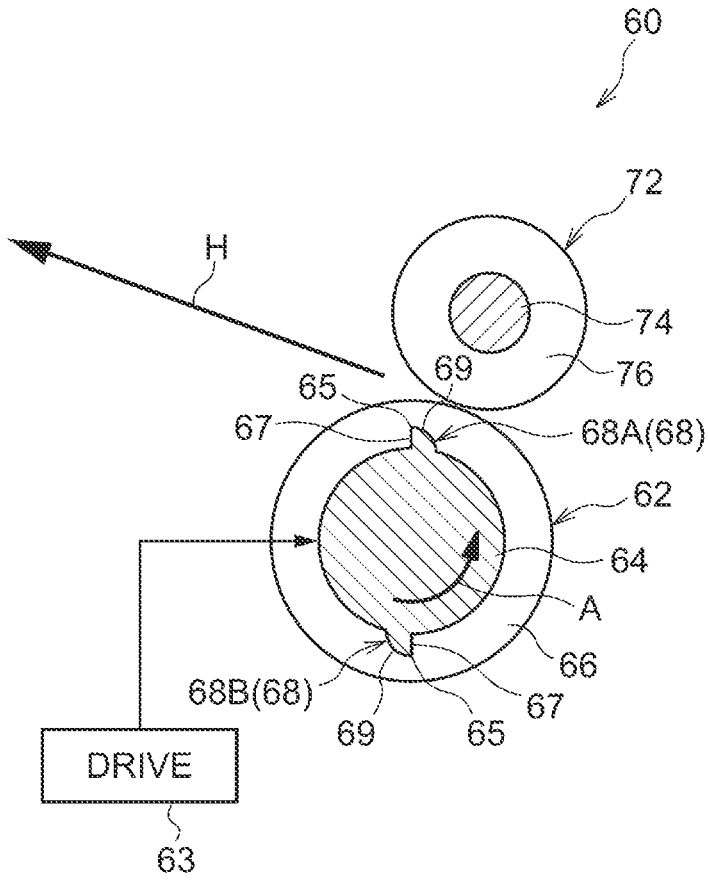
FIG. 2 is a schematic view, partially in cross section, of the structure of a discharge mechanism relating to the present exemplary embodiment.
Figure 3:
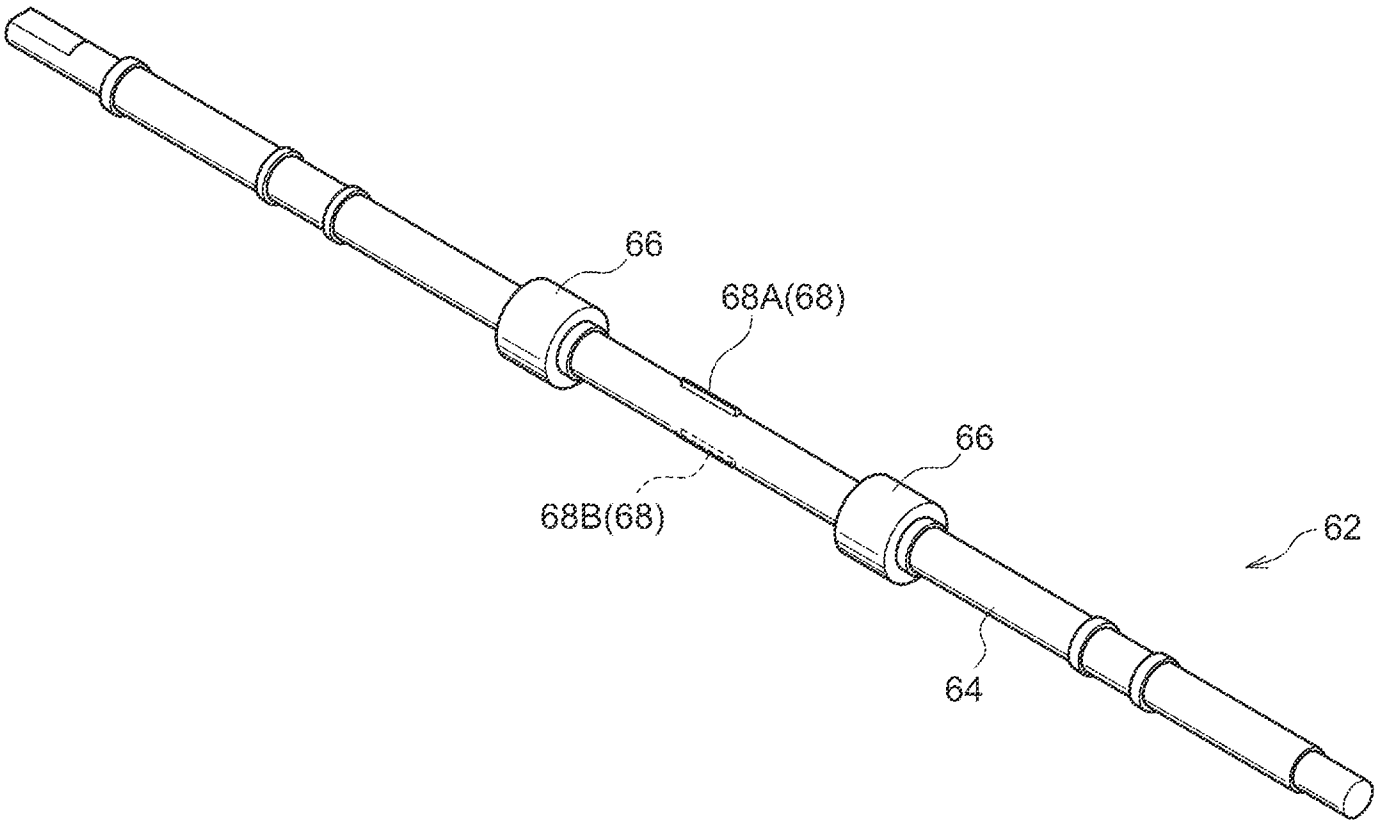
FIG. 3 is a schematic perspective view showing the structure of a discharge roller relating to the present exemplary embodiment.

The structure of the discharge mechanism 60 relating to the present exemplary embodiment will be described first. FIG. 2 is a schematic view, partially in cross section, of the structure of the discharge mechanism 60 relating to the present exemplary embodiment. FIG. 3 is a schematic perspective view showing the structure of a discharge roller 62 relating to the present exemplary embodiment.

As shown in FIG. 2, the discharge mechanism 60 relating to the present exemplary embodiment includes the discharge roller 62 and an opposing roller 72 disposed above the discharge roller 62.

As shown in FIGS. 2 and 3, the discharge roller 62 includes a rotating shaft 64 that is rotatable, and roll portions 66 that are formed in the shape of a ring and provided around the rotating shaft 64.

Similarly to the discharge roller 62, the opposing roller 72 includes a rotating shaft 74 that is rotatable, and roll portions 76 that are formed in the shape of a ring and provided around the rotating shaft 74. The roll portion 76 is provided above the roll portion 66 of the discharge roller 62 and opposes the roll portion 66. Namely, the roll portion 76 serves as an opposing member that opposes the roll portion 66. The opposing member may be an opposing belt formed by a belt body, or may be the rotating shaft 74 itself.

In the present exemplary embodiment, the roll portions 66 of the discharge roller 62 are disposed at two locations of the rotating shaft 64 such that a central portion of the rotating shaft 64 in an axial direction thereof is located between the roll portions 66. The roll portions 66 may be disposed at three or more locations of the rotating shaft 64.

The roll portions 76 and 66 are formed of, for example, rubber materials, while the rotating shafts 74 and 64 are formed of, for example, resin, metal or the like. Further, the roll portion 66 and the rotating shaft 64 may be an integrally formed resin product.

The discharge roller 62 serves as a driving roller. A rotational force is applied via a transmission member, such as a gear, to the rotating shaft 64 from a drive 63 that drives to rotate the rotating shaft 64. The opposing roller 72, on the other hand, serves as a driven roller that is not driven by the drive 63 but is rotated by the discharge roller 62 serving as the driving roller. The opposing roller 72 may also be a driving roller.

The discharge roller 62 and the opposing roller 72 are structured so as to hold, convey and discharge the recording medium P, which is an example of the materials to be conveyed, to the recording medium discharge section 20. Specifically, the recording medium P is held between the roll portion 66 of the discharge roller 62 and the roll portion 76 of the opposing roller 72 and conveyed thereby. In FIG. 2, the direction in which the discharge roller 62 is rotated is indicated by arrow A, while the conveying direction (discharging direction) of the recording medium P is indicated by arrow H.

Protrusions 68 are formed on an outer periphery of the rotating shaft 64 and protrude outward from an outer peripheral surface of the rotating shaft 64 in a radial direction thereof. The height of the protrusion 68 is set such that the protrusion 68 does not extend beyond the outer diameter of the roll portion 66. The protrusion 68 also extends along the axial direction of the rotating shaft 64.

In the present exemplary embodiment, the protrusions 68 are composed of protrusions 68A and 68B. The protrusions 68A and 68B are disposed at positions at which they overlap each other in the axial direction of the rotating shaft 64. Namely, the positions through which the protrusions 68A and 68B pass when the rotating shaft 64 is rotated overlap.

Further, the protrusions 68A and 68B are disposed at different positions in a peripheral direction of the rotating shaft 64, as shown in FIG. 2. The protrusion 68A is disposed on the rotating shaft 64 at a position opposite to the protrusion 68B. Specifically, the protrusions 68A and 68B are disposed at positions at which at least portions of the protrusions 68A and 68B overlap each other when the rotating shaft 64 is viewed in the radial direction. More specifically, the protrusions 68A and 68B are disposed in such a positional relationship that they are disposed at the same positions in the axial direction of the rotating shaft 64 and spaced 180° apart thereon.

Moreover, the protrusions 68A and 68B are disposed between the roll portions 66, namely, at the axial direction central portion of the rotating shaft 64.

As shown in FIG. 2, the protrusions 68A and 68B have a first surface 67, which is formed along the radial direction of the rotating shaft 64 when seen from one end side of the rotating shaft 64 in the axial direction thereof, and faces the rotational direction of the rotating shaft 64 when the recording medium P is discharged. The first surface 67 is formed along the axial direction of the rotating shaft 64 when seen from an outer side of the rotating shaft 64 in the radial direction thereof.

The protrusions 68A and 68B also have a second surface 69 that is formed at the opposite side of the first surface 67. As the second surface 69 extends towards the radial direction outer side of the rotating shaft 64, the second surface 69 becomes gradually closer to the first surface 67 when seen from the axial direction one end side of the rotating shaft 64. Specifically, the second surface 69 gradually follows the shape of an arc as it extends toward the radial direction outer side of the rotating shaft 64.

The second surface 69 is formed along the axial direction of the rotating shaft 64 when seen from the radial direction outer side thereof. A corner portion 65, at which the first surface 67 and the second surface 69 connect at the radial direction outer side of the rotating shaft 64, is formed at the protrusion 68.

Figure 4A:
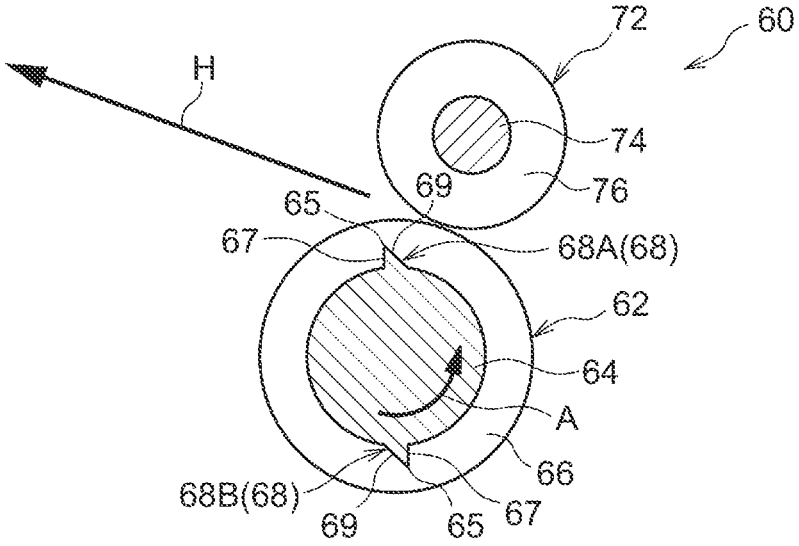
FIGS. 4A, 4B and 4C are schematic views showing modifications of the shape of protrusions formed on the discharge roller relating to the present exemplary embodiment.

Various shapes may be used for the protrusion 68. For example, as shown in FIG. 4A, the second surface 69 may be a straight inclined surface when seen from the axial direction one end side of the rotating shaft 64. In this case, the protrusion 68 has a substantially triangular configuration when seen from the axial direction one end side of the rotating shaft 64.

Figure 4B:
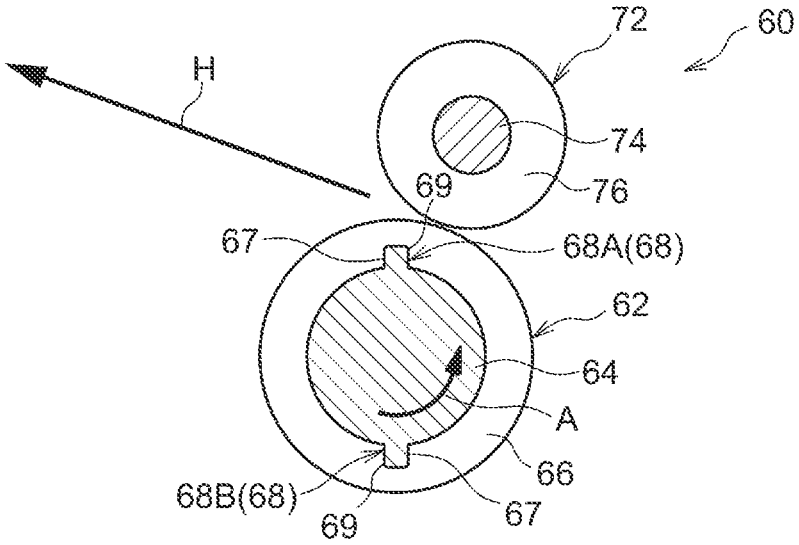

Further, similarly to the first surface 67, the second surface 69 may be formed along the radial direction of the rotating shaft 64 when seen from the axial direction one end side of the rotating shaft 64, as shown in FIG. 4B. In this case, the protrusion 68 has a substantially quadrangular configuration when seen from the axial direction one end side of the rotating shaft 64.

Figure 4C:
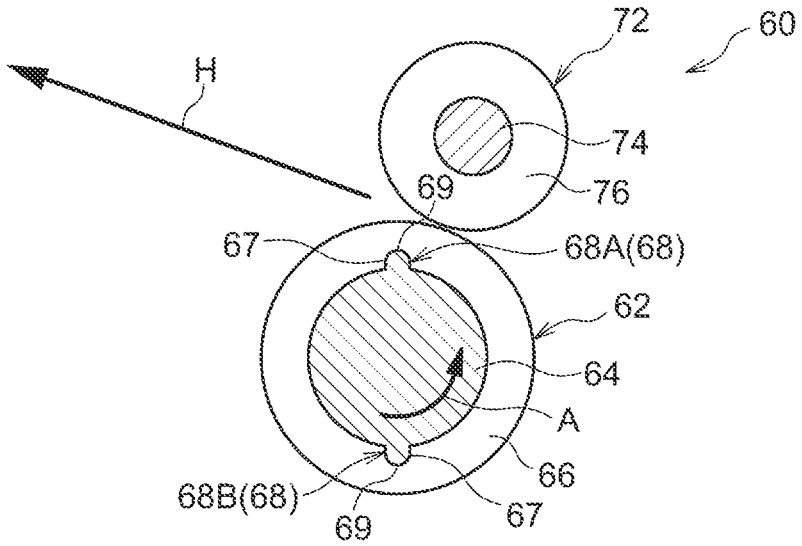

Furthermore, as shown in FIG. 4C, the first surface 69 and the second surface 67 may be formed in the shape of a continuous arc when seen from the axial direction one end side of the rotating shaft 64. In this case, the protrusion 68 has a substantially semicircular configuration when seen from the axial direction one end side of the rotating shaft 64.

Moreover, in the present exemplary embodiment, when the image forming section 14 sequentially form images on the recording media P, the drive 63 rotates the rotating shaft 64 at least half a turn during the time duration from when the roll portion 66 discharges the recording medium P to the recording medium discharge section 20 to when the subsequent recording medium P reaches the roll portion 60. In this structure, the two protrusions 68 are formed along the peripheral direction of the rotating shaft 64 and at the positions at which the projections 68 overlap each other in the axial direction of the rotating shaft 64. Thus, after the roll portion 66 discharges the recording medium P to the recording medium discharge section 20 and before the subsequent recording medium P reaches the roll portion 60, each protrusion 68 passes at least once over the entire periphery of the rotating shaft 64.

Further, the drive 63 rotates the rotating shaft 64 at least half a turn within the duration of time, which is the sum of the time from when the roll portion 66 discharges the recording medium P to the recording medium discharge section 20 to when the rotation of the rotating shaft 64 is stopped, and the time from when the rotating shaft 64, the rotation of which has been stopped, is rotated again to when the subsequent recording medium P reaches the roll portion 66.

In this case as well, the protrusion 68 passes at least once over the entire periphery of the rotating shaft 64 during the time duration from when the roll portion 66 discharges the recording medium P to the recording medium discharge section 20 to when the rotation of the rotating shaft 64 is stopped, and the time duration from when the rotating shaft 64, the rotation of which has been stopped, is rotated again to when the subsequent recording medium P reaches the roll portion 60.

Discharge of the recording medium P to the recording medium discharge section 20 by the roll portions 66 can be detected by, for example, sensing the recording medium P in the recording medium accommodating section 12 or the first conveying path 17, and determining the conveying time taken from the sensing to the discharge of the recording medium P, on the basis of conveying time that has been measured in advance.

Operation of Discharge Mechanism 60 Relating to the Present Exemplary Embodiment Operation of the discharge mechanism 60 relating to the present exemplary embodiment will be described next.

Figure 5A:
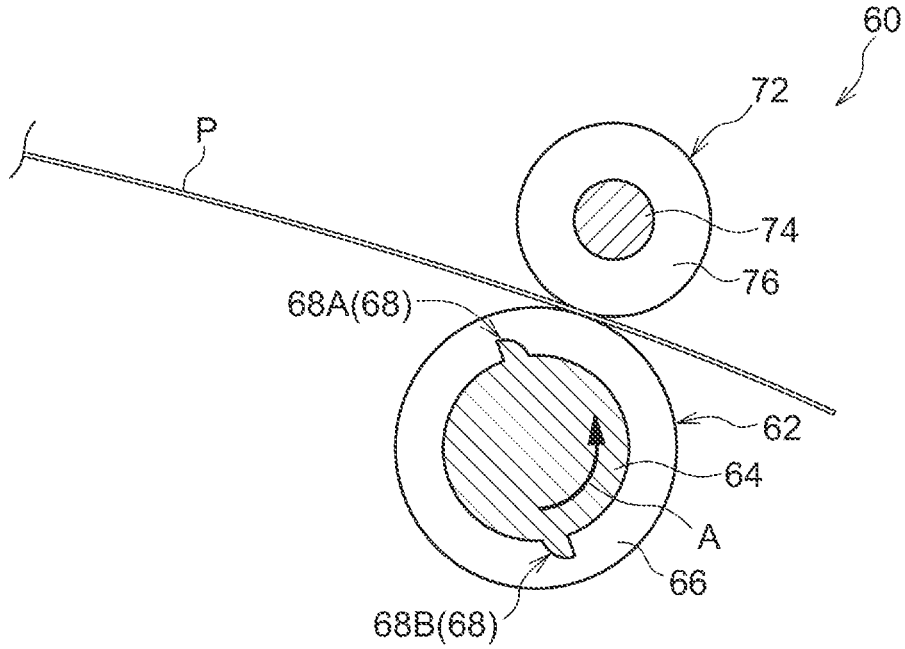
FIGS. 5A and 5B are schematic views each showing discharge operation of a recording medium in the discharge mechanism relating to the present exemplary embodiment.

In the discharge mechanism 60 relating to the present exemplary embodiment, the recording medium P that has been fed from the fixing device 18 is held between the roll portions 66 of the discharge roller 62 and the roll portion 76 of the opposing roller 72, and conveyed and discharged to the recording medium discharge section 20, as shown in FIG. 5A.

Figure 5B:
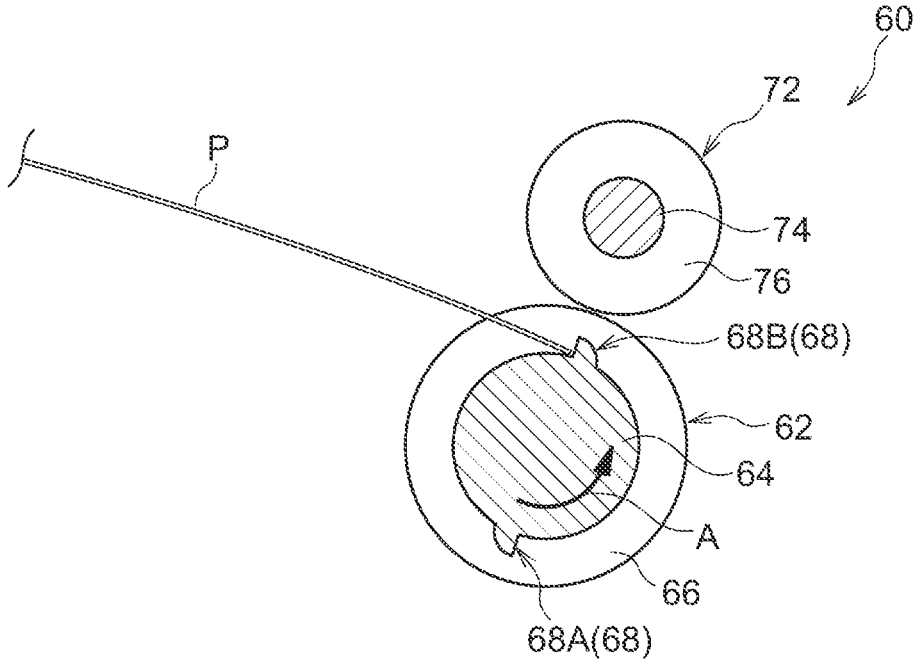
Figure 6:
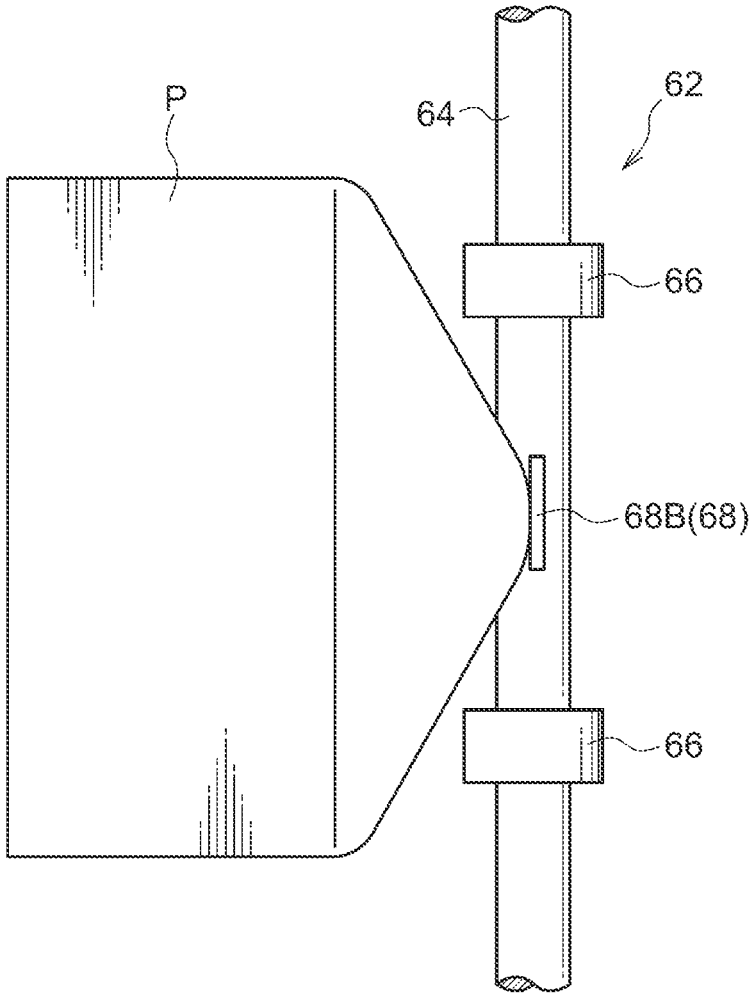
FIG. 6 is a schematic plan view showing a state in which a trailing end portion of the recording medium rests on a rotating shaft of the discharge roller relating to the present exemplary embodiment.

During this conveyance of the recording medium P, when a trailing end portion of the recording medium P has a different shape as shown in FIG. 6, the entire recording medium P may not be discharged to the recording medium discharge section 20, and the trailing end portion (the upstream-side end portion in the conveying direction) of the recording medium P may rest on the rotating shaft 64 at a position between the two roll portions 66, as shown in FIGS. 5B and 6.

Figure 7:
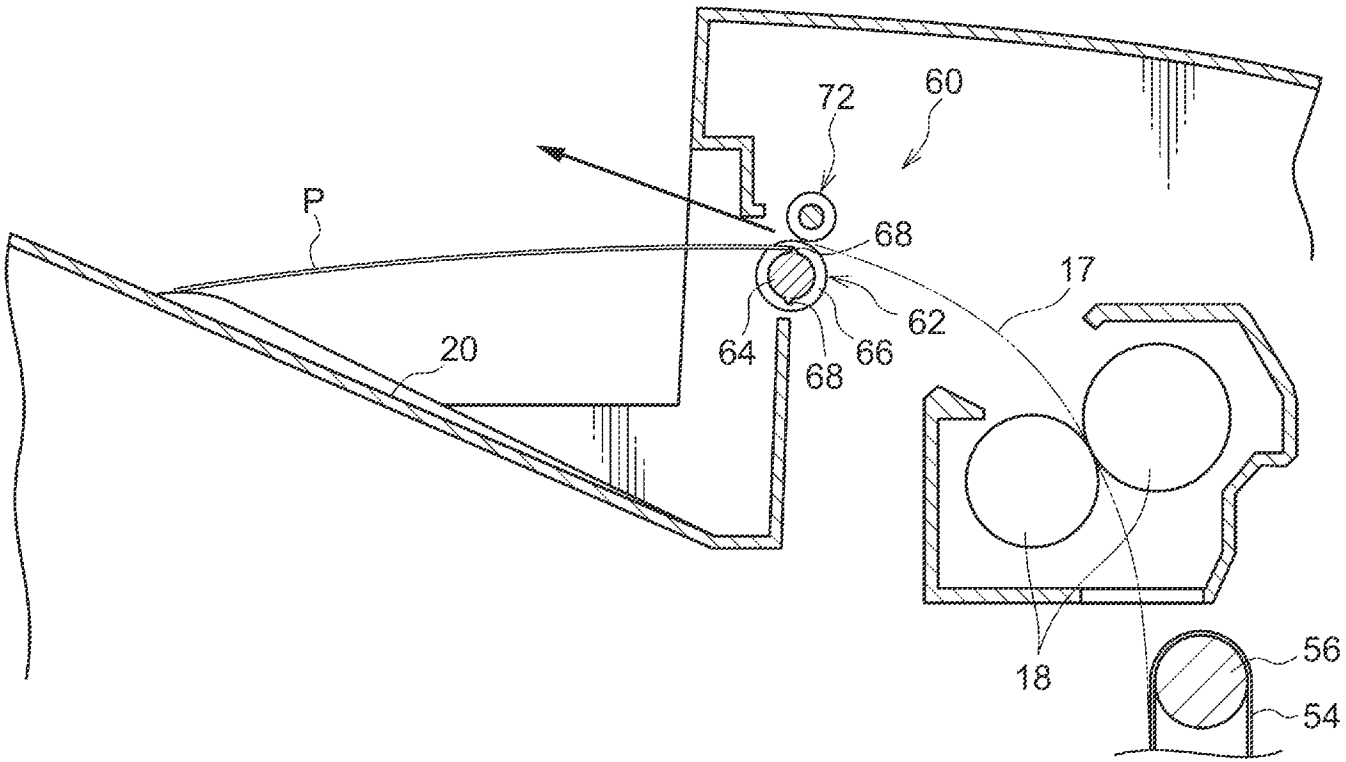
FIG. 7 is a schematic view showing a way in which a leading end portion of the recording medium meets resistance at a recording medium discharge section, the recording medium having been discharged by the discharge mechanism relating to the present exemplary embodiment.

The reason for this may be that, for example, a leading end portion (the downstream-side end portion in the conveying direction) of the recording medium P impinges on a bottom surface or the like of the recording medium discharge section 20 and meets resistance thereat, shown in FIG. 7.

An example of the different shape of the trailing end portion may be a shape that becomes narrow toward the trailing end portion of the recording medium P, specifically a triangle formed at the trailing end portion. An example of the recording medium P having a trailing end portion of different shape is an envelope with a flap being open toward the trailing end portion side.

In the present exemplary embodiment, when the trailing end portion of the recording medium P rests on the rotating shaft 64, the rotating shaft 64 is rotated at least half a turn by the time when the subsequent recording medium P reaches the roll portions 66. The protrusions 68 formed on the rotating shaft 64 thrust the trailing end portion of the recording medium P, whereby the recording medium P is discharged to the recording medium discharge section 20.

Figure 8:
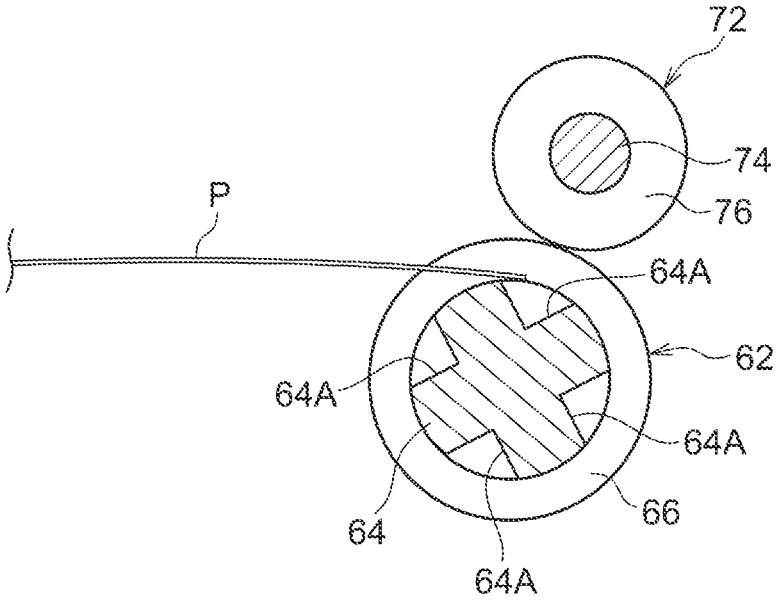
FIG. 8 is a schematic view showing a comparative example in which depressions are formed in the rotating shaft of the discharge roller relating to the present exemplary embodiment.

If, as shown in FIG. 8, depressions 64A are formed in the curved outer peripheral surface of the rotating shaft 64 of the discharge roller 62 in place of the protrusions 68, when the trailing end portion of the recording medium P rests on the rotating shaft 64, the state in which the trailing end portion rests on the outer peripheral surface of the rotating shaft 64 continues, and it is difficult for the trailing end portion to go into the depression 64A. Consequently, the trailing end portion of the recording medium P cannot be sufficiently thrust by an edge of the depression 64A.

On the contrary, in the present exemplary embodiment, the protrusion 68 is provided on the curved outer peripheral surface of the rotating shaft 64. Therefore, the trailing end portion of the recording medium P resting on the outer peripheral surface of the rotating shaft 64 is sufficiently thrust by the protrusion 68.

Further, the recording medium P is discharged with the recording surface facing the discharge roller 62. Since the protrusion 68 does not extend beyond the roll portion 66, scraping, by the protrusion 68, of the recording surface of the recording medium P is prevented. As a result, defects caused by the protrusion 68 scraping the recording surface are prevented.

Figure 9:
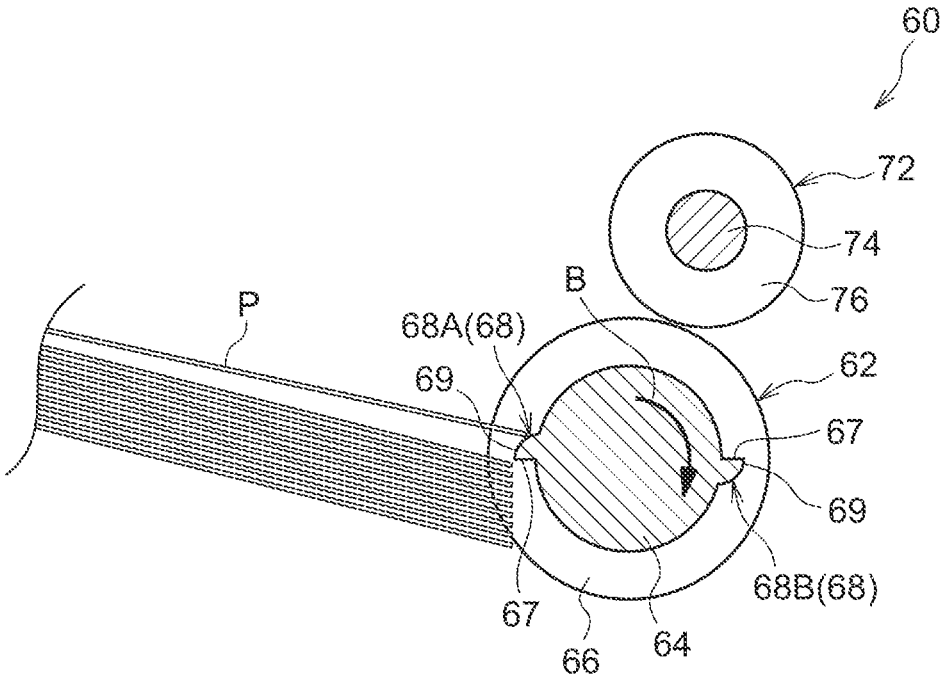
FIG. 9 is a schematic view showing a state in which the discharge roller relating to the present exemplary embodiment is reversed.

Furthermore, as shown in FIG. 9, even when the discharge roller 62 is reversed in the direction of arrow B in FIG. 9 at the time of recording images on both sides of the recording medium P, the recording medium P held in the recording medium discharge section 20 abuts the second surface 69 of the protrusion 68. Thus, the recording medium P is hardly subjected to resistance, and pickup of the recording medium P held in the recording medium discharge section 20 is prevented. Consequently, formation of jams due to the recording medium P that has already been discharged going into the second conveying path 19 for duplex (two-sided) recording is prevented.

Figure 10A:
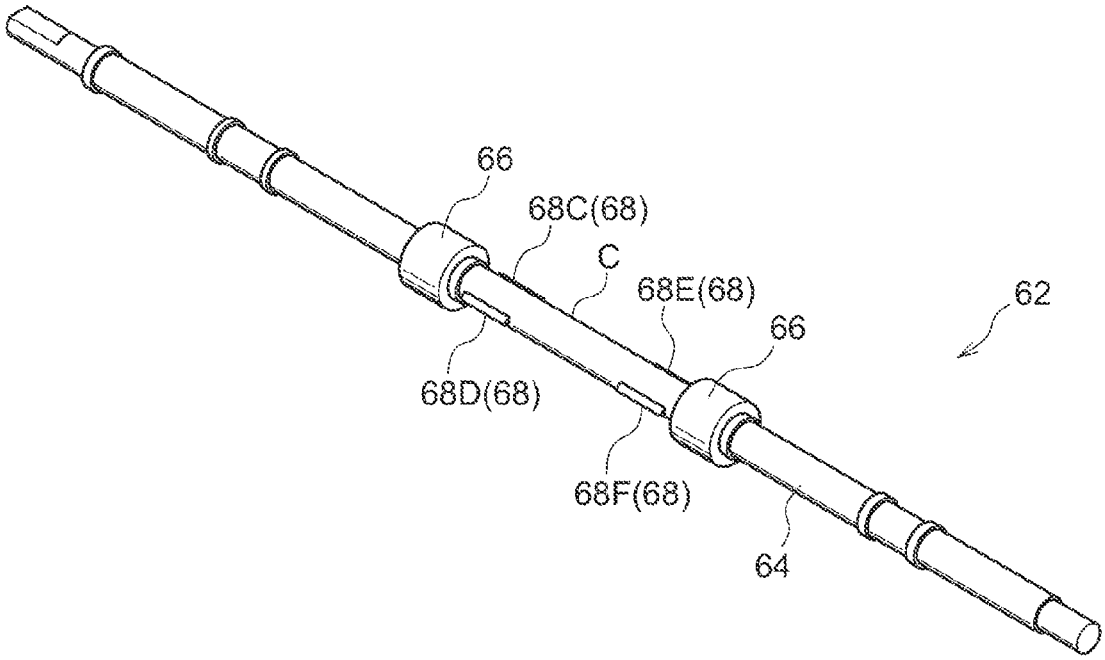
FIGS. 10A and 10B are schematic perspective views showing a modification in which four protrusions are formed on the discharge roller relating to the present exemplary embodiment.
Figure 10B:
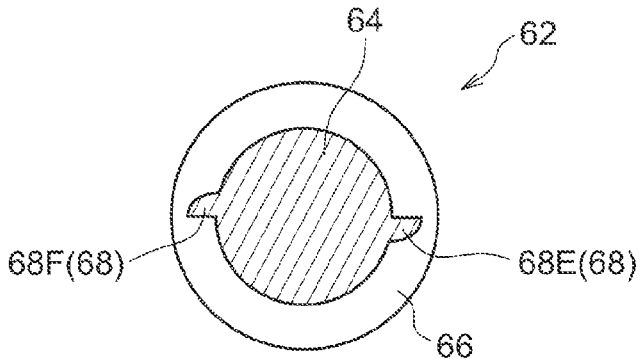

The plural protrusions 68 may be four protrusions such as protrusions 68C, 68D, 68E and 68F as shown in FIGS. 10A and 10B. The protrusions 68C, 68D, 68E and 68F are disposed between the two roll portions 66.

The protrusions 68C and 68D are disposed at positions that overlap in the axial direction of the rotating shaft 64, and the same applies to the protrusions 68E and 68F. Namely, when the rotating shaft 64 is rotated, the positions at which the protrusions 68C and 68D pass overlap, and the positions at which the protrusions 68E and 68F pass overlap.

The protrusions 68C and 68D, and the protrusions 68E and 68F are formed at different positions of the rotating shaft 64 in the axial direction thereof. The protrusions 68C and 68D, and the protrusions 68E and 68F are disposed at positions closer to the roll portions 66 than the center of the rotating shaft 64.

The protrusions 68C and 68D are disposed at different positions of the rotating shaft 64 in the peripheral direction thereof. The same applies to the protrusions 68E and 68F.

The protrusion 68C is disposed on the rotating shaft 64 at a position opposite to the protrusion 68D, while the protrusion 68E is disposed on the rotating shaft 64 at a position opposite to the protrusion 68F. Specifically, the protrusions 68C and 68D are disposed at positions at which at least portions of the protrusions 68C and 68D overlap each other, and the protrusions 68E and 68F are disposed at positions at which at least portions of the protrusions 68E and 68F overlap each other, when the rotating shaft 64 is viewed in a radial direction thereof.

More specifically, the protrusions 68C and 68D are disposed in such a positional relationship that they are disposed at the same positions in the axial direction of the rotating shaft 64 and spaced 180° apart thereon. Similarly, the protrusions 68E and 68F are disposed in such a positional relationship that they are disposed at the same positions in the axial direction of the rotating shaft 64 and spaced 180° apart thereon.

The protrusions 68C and 68E are disposed on the rotating shaft 64 at positions at which they overlap each other in the peripheral direction. Similarly, the protrusions 68D and 68F are disposed on the rotating shaft 64 at positions at which they overlap each other in the peripheral direction. Namely, when seen from the axial direction one end side of the rotating shaft 64, the protrusions 68C and 68E overlap each other, and the protrusions 68D and 68F overlap each other.

Figure 11A:
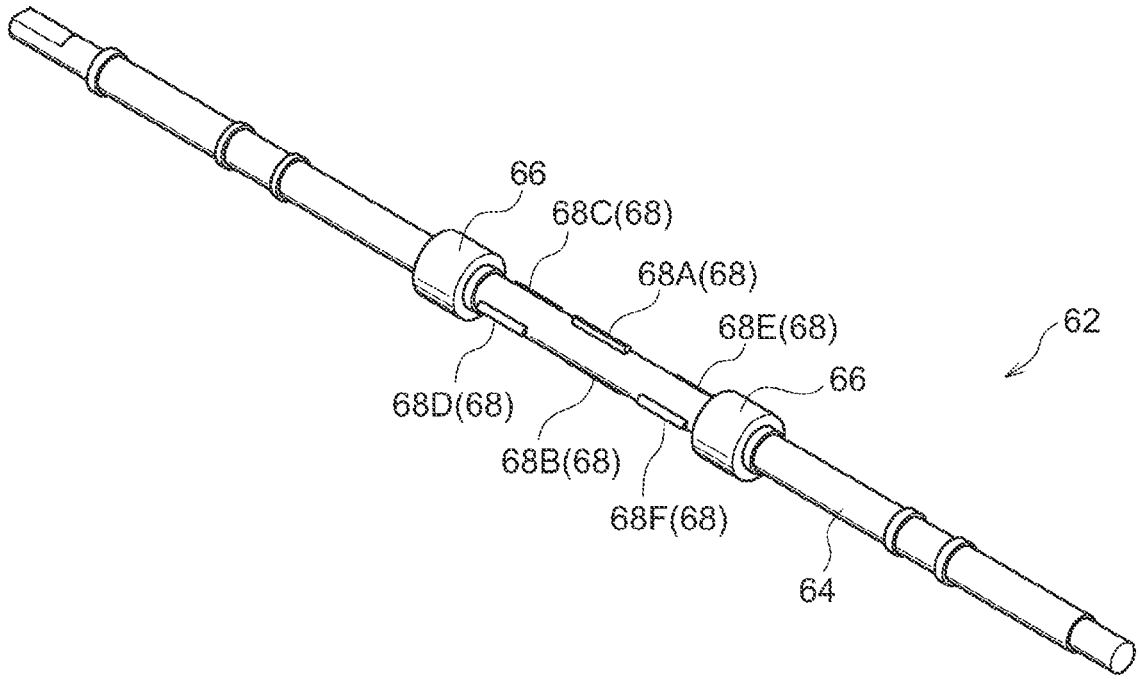
FIGS. 11A and 11B are schematic perspective views showing a modification in which six protrusions are formed on the discharge roller relating to the present exemplary embodiment.
Figure 11B:
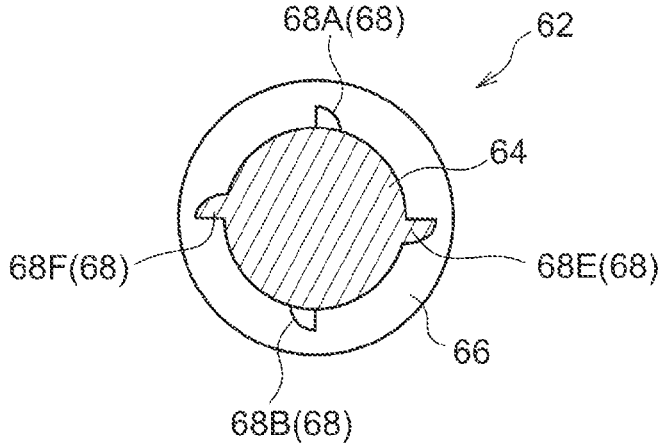

Moreover, the plural protrusions 68 may be six protrusions, such as protrusions 68A through 68F shown in FIGS. 11A and 11B. The protrusions 68A through 68F have the same structure as that of the protrusions with the same reference numerals shown in FIGS. 2, 3, 10A and 10B.

The protrusions 68A and 68B, and the protrusions 68C (68E) and 68D (68F) are disposed on the rotating shaft 64 at different positions in the peripheral direction thereof. Specifically, when seen from the axial direction one end side of the rotating shaft 64, the protrusions 68A, 68C (68E) and 68D (68F) are disposed on the rotating shaft 64 in such a positional relationship that the protrusion 68A is spaced 90° apart from the protrusions 68C (68E) and 68D (68F). Similarly, the protrusions 68B, 68C (68E) and 68D (68F) are disposed on the rotating shaft 64 in such a positional relationship that the protrusion 68B is spaced 90° apart from the protrusions 68C (68E) and 68D (68F).

The protrusions 68C (68D) and 68E (68F) are disposed closer to the roll portions 66 than the protrusion 68A (68B) is. Further, the protrusions 68C, 68D, 68E and 68F protrude beyond the protrusions 68A and 68B in the radial direction of the rotating shaft 64.

Because of this structure, when the trailing end portion of the recording medium P rests on the rotating shaft 64, the recording medium P can be thrust onto the recording medium discharge section 20 even when the recording medium P is separated from the rotating shaft 64 at a position close to the roll portion 66.

On the other hand, the recording medium P held between the roll portions 66 of the discharge roller 62 and the roll portion 76 of the opposing roller 72 and conveyed is hardly deflected toward the rotating shaft 64 at positions near the roll portions 66. Thus, the protrusion 68 hardly scrapes the recording surface of the recording medium P. As a result, defects caused by the protrusion 68 scraping the recording surface are prevented.

Figure 12:
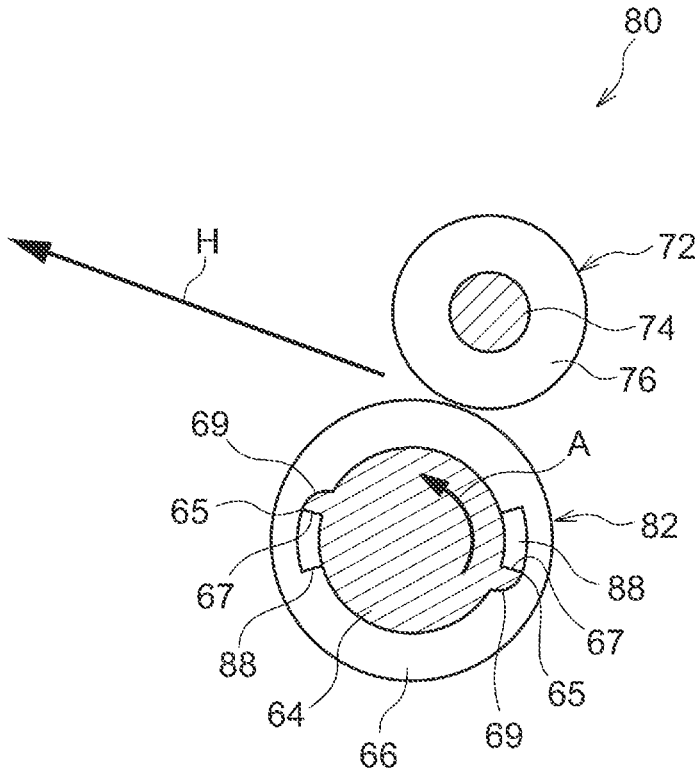
FIG. 12 is a schematic view, partially in cross section, of the structure of a discharge mechanism relating to a modified embodiment.

Modified Embodiment of Discharge Mechanism Relating to the Present Exemplary Embodiment Next, the structure of a discharge mechanism 80 relating to a modified embodiment will be described. FIG. 12 is a schematic view showing the structure of the discharge mechanism 80 relating to the modified embodiment. Note that the same reference numerals are used to designate parts that are the same as those in the discharge mechanism 60, and detailed description thereof will be omitted.

The discharge mechanism 80 relating to the modified embodiment includes a discharge roller 82, and the opposing roller 72 above the discharge roller 82, as shown in FIG. 12.

Figure 13:
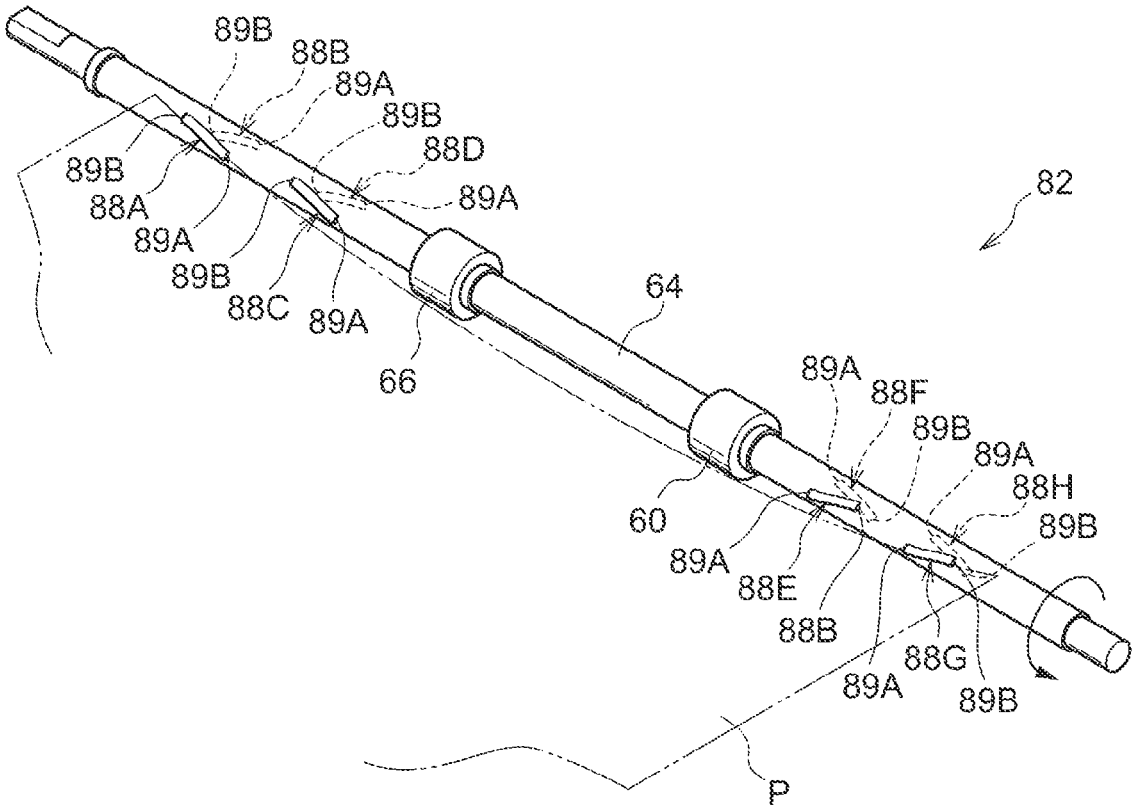
FIG. 13 is a schematic perspective view showing the structure of a discharge roller of the discharge mechanism relating to the modified embodiment.
Figure 14:
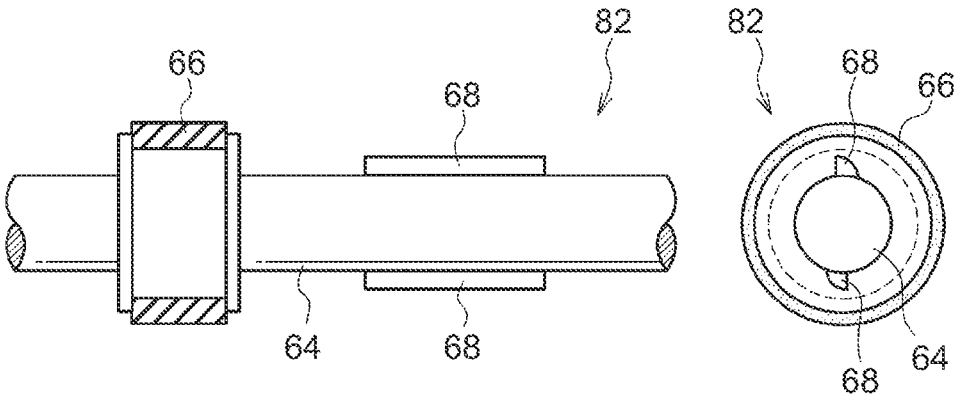
FIG. 14 is a schematic view showing the size relationship between the inner diameter of a roll portion and the outer diameter of a rotating shaft including protrusions in the discharge mechanism relating to the modified embodiment.

Similarly to the discharge roller 62, as shown in FIGS. 12 and 13, the discharge roller 82 includes the rotating shaft 64 that is rotatable, and the roll portions 66 that are provided around the rotating shaft 64.

In this discharge roller 82, as shown in FIG. 13, plural protrusions 88 are formed on the outer periphery of the rotating shaft 64 and protrude outward in the radial direction thereof from the outer peripheral surface of the rotating shaft 64. The height of the protrusion 88 is set such that the protrusion 88 does not extend beyond the outer diameter of the roll portion 66. The protrusion 88 also extends along the axial direction of the rotating shaft 64.

As shown in FIG. 12, the protrusion 88 has the first surface 67, which is formed along a substantially radial direction of the rotating shaft 64 when seen from the axial direction one end side of the rotating shaft 64, and faces the rotational direction of the rotating shaft 64 when the recording medium P is discharged. The first surface 67 is formed so as to extend substantially along the axial direction of the rotating shaft 64 when seen from the radial direction outer side of the rotating shaft 64.

The protrusion 88 also has the second surface 69 that is formed at the opposite side of the first surface 67. As the second surface 69 extends in the radial direction outer side of the rotating shaft 64, the second surface 69 is gradually closer to the first surface 67 when seen from the axial direction one end side of the rotating shaft 64. Specifically, the second surface 69 gradually follows the shape of an arc as it extends toward the radial direction outer side of the rotating shaft 64.

The second surface 69 is formed so as to extend substantially along the axial direction of the rotating shaft 64 when seen from the radial direction outer side thereof. The corner portion 65, at which the first surface 67 and the second surface 69 connect at the radial direction outer side of the rotating shaft 64, is formed at the protrusion 88.

Various shapes may be used for the protrusion 88. For example, the second surface 69 may be a straight inclined surface when seen from the axial direction one end side of the rotating shaft 64 (see FIG. 4A). In this case, the protrusion 88 has a substantially triangular configuration when seen from the axial direction one end side of the rotating shaft 64.

Further, similarly to the first surface 67, the second surface 69 may be formed along the radial direction of the rotating shaft 64 when seen from the axial direction one end side of the rotating shaft 64. In this case, the protrusion 88 has a substantially quadrangular configuration when seen from the axial direction one end side of the rotating shaft 64 (see FIG. 4B).

The plural protrusions 88 are formed by eight protrusions, namely, protrusions 88A, 88B, 88C, 88D, 88E, 88F, 88G and 88H.

The protrusions 88A through 88H are disposed at positions further outward in the axial direction of the rotating shaft 64 than the roll portions 66.

The protrusions 88A through 88D are disposed at the axial direction one end side of the rotating shaft 64, while the protrusions 88E through 88H are disposed at the other end side of the rotating shaft 64 in the axial direction.

The protrusions 88A through 88H face outward with respect to the rotational direction of the rotating shaft 64. Specifically, when seen from the radial direction outer side of the rotating shaft 64, the protrusions 88A through 88H are disposed at an angle with respect to the axial direction of the rotating shaft 64. Further, an end portion 89A at a center side of the rotating shaft 64 in the axial direction thereof (i.e., the side close to the roll portion 66) is disposed at a downstream side of the rotating shaft 64 in the rotational direction. Furthermore, an end portion 89 at an outer side of the rotating shaft 64 in the axial direction thereof (i.e., the side far from the roll portion 66) is disposed at an upstream side of the rotating shaft 64 in the rotational direction.

The protrusions 88A and 88B are disposed at positions that overlap in the axial direction of the rotating shaft 64, and the same applies to the protrusions 88C and 88D. Namely, when the rotating shaft 64 is rotated, the positions at which the protrusions 88A and 88B pass overlap, and the positions at which the protrusions 88C and 88D pass overlap.

The protrusions 88A and 88B, and the protrusions 88C and 88D are formed at different positions of the rotating shaft 64 in the axial direction thereof. The protrusions 88C and 88D are disposed at positions closer to the roll portion 66 than the protrusions 88A and 88B are.

The protrusions 88A and 88B are disposed at different positions of the rotating shaft 64 in the peripheral direction thereof. The same applies to the protrusions 88C and 88D.

The protrusion 88A is disposed on the rotating shaft 64 at a position opposite to the protrusion 88B, while the protrusion 88C is disposed on the rotating shaft 64 at a position opposite to the protrusion 88D. Specifically, the protrusions 88A and 88B are disposed at positions at which at least portions of the protrusions 88A and 88B overlap each other, and the protrusions 88C and 88D are disposed at positions at which at least portions of the protrusions 88C and 88D overlap each other, when the rotating shaft 64 is viewed in the radial direction thereof.

More specifically, the protrusions 88A and 88B are disposed in such a positional relationship that they are disposed at the same positions in the axial direction of the rotating shaft 64 and spaced 180° apart thereon. Similarly, the protrusions 88C and 88D are disposed in such a positional relationship that they are disposed at the same positions in the axial direction of the rotating shaft 64 and spaced 180° apart thereon.

The protrusions 88A and 88C are disposed on the rotating shaft 64 at positions at which they overlap each other in the peripheral direction. Similarly, the protrusions 88B and 88D are disposed on the rotating shaft 64 at positions at which they overlap each other in the peripheral direction. Namely, when seen from the axial direction one end side of the rotating shaft 64, the protrusions 88A and 88C overlap each other, and the protrusions 88B and 88D overlap each other.

Further, the protrusions 88E and 88F are disposed at positions that overlap in the axial direction of the rotating shaft 64, and the same applies to the protrusions 88G and 88H. Namely, when the rotating shaft 64 is rotated, the positions at which the protrusions 88E and 88F pass overlap, and the positions at which the protrusions 88G and 88H pass overlap.

The protrusions 88E and 88F, and the protrusions 88G and 88H are formed at different positions of the rotating shaft 64 in the axial direction thereof. The protrusions 88E and 88F are disposed at positions closer to the roll portion 66 than the protrusions 88G and 88H are.

The protrusions 88E and 88F are disposed at different positions of the rotating shaft 64 in the peripheral direction thereof. The same applies to the protrusions 88G and 88H.

The protrusion 88E is disposed on the rotating shaft 64 at a position opposite to the protrusion 88F, while the protrusion 88G is disposed on the rotating shaft 64 at a position opposite to the protrusion 88H. Specifically, the protrusions 88E and 88F are disposed at positions at which at least portions of the protrusions 88E and 88F overlap each other, and the protrusions 88G and 88H are disposed at positions at which at least portions of the protrusions 88G and 88H overlap each other, when the rotating shaft 64 is viewed in the radial direction thereof.

More specifically, the protrusions 88E and 88F are disposed in such a positional relationship that they are disposed at the same positions in the axial direction of the rotating shaft 64 and spaced 180° apart thereon. Similarly, the protrusions 88G and 88H are disposed in such a positional relationship that they are disposed at the same positions in the axial direction of the rotating shaft 64 and spaced 180° apart thereon.

The protrusions 88E and 88G are disposed on the rotating shaft 64 at positions at which they overlap each other in the peripheral direction. Similarly, the protrusions 88F and 88H are disposed on the rotating shaft 64 at positions at which they overlap each other in the peripheral direction. Namely, when seen from the axial direction one end side of the rotating shaft 64, the protrusions 88E and 88G overlap each other, and the protrusions 88F and 88H overlap each other.

Further, the portion of the rotating shaft 64 to which the roll portion 66 is mounted is thicker than the protrusion 88. Thus, the inner diameter of the roll portion 66 is larger than the outer diameter of the rotating shaft 64 including the protrusions 88. In this way, the protrusions 88 are less likely to be obstacles when the roll portion 66 is mounted to the rotating shaft 64 from the axial direction outer side thereof.

Operation of Discharge Mechanism 80 Relating to Modified Embodiment

Operation of the discharge mechanism 80 relating to the modified embodiment will be described next.

In the discharge mechanism 80 relating to the present modified embodiment, the recording medium P that has been fed from the fixing device 18 is held between the roll portions 66 of the discharge roller 82 and the roll portion 76 of the opposing roller 72, and conveyed and discharged to the recording medium discharge section 20.

During this conveyance of the recording medium P, the entire recording medium P may not be discharged to the recording medium discharge section 20, and the trailing end portion (the upstream-side end portion in the conveying direction) of the recording medium P may rest on the rotating shaft 64 at outer sides of the two roll portions 66, as shown in FIG. 13.

The reason for this may be that, for example, side end portions of the recording medium P curl and lift upward.

Particularly in the case that a large number of the recording media P are accommodated in the recording medium discharge section 20, when the central portion of the recording media P between the side end portions is placed on the recording medium P accommodated in the recording medium discharge section 20, the recording medium P curls and the side end portions thereof lift upward, resulting in that the trailing end portion of the recording medium P near the sides rests on the rotating shaft 64.

In the present modified embodiment, when the trailing end portion of the recording medium P rests on the rotating shaft 64, the protrusions 88 formed on the rotating shaft 64 thrust (propel) the trailing end portion of the recording medium P, whereby the recording medium P is discharged to the recording medium discharge section 20.

The protrusion 88 faces outward with respect to the rotating direction of the rotating shaft 64 and is positioned along the trailing end portion of the recording medium P having the curled side end portions. Therefore, the recording medium P is easily thrust by the protrusion 88.

Further, the recording medium P is discharged with the recording surface facing the discharge roller 82. Since the protrusion 88 does not extend beyond the roll portion 66, scraping, by the protrusion 88, of the recording surface of the recording medium P is prevented.

Furthermore, even when the discharge roller 82 is reversed at the time of recording images on both sides of the recording medium P, the recording medium P held in the recording medium discharge section 20 abuts the second surface 69 of the protrusion 88. Thus, the recording medium P is hardly subjected to resistance, and pickup of the recording medium P accommodated in the recording medium discharge section 20 is prevented (see FIG. 9).

Figure 15:
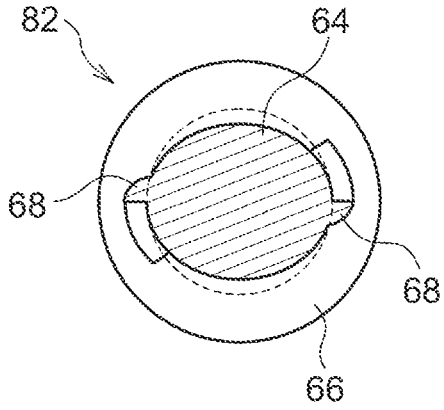
FIG. 15 is a schematic view showing the discharge mechanism relating to the modified embodiment, which is structured such that the rotating shaft is formed in a flattened shape.

The rotating shaft 64 may be formed such that the portion at which the protrusion 88 is formed has a flattened shape, as shown in FIG. 15. Specifically, the rotating shaft 64 has an oval cross section. It is sufficient if the flattened shape is formed by pressing and deforming the rotating shaft 64 that has a circular cross section. Further, in the structure shown in FIG. 15, the portion of the rotating shaft 64 at which the protrusion 88 is not formed may have a circular cross section as indicated by a dotted line in FIG. 15. The entire rotating shaft 64 need not be formed in the flattened shape.

In this structure, the roll portion 66 need not be stretched, but is pressed and made flattened when mounted to the rotating shaft 64 from the axial direction outer side thereof. In this way, damage to the roll portion 66 is prevented.

The present invention is not limited to the embodiments described above, and may include various variations, modifications and improvements.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A discharge mechanism comprising:

a rotating shaft that is rotatable;

a plurality of roll portions provided around the rotating shaft;

an opposing member provided above the roll portions so as to oppose the roll portions, the opposing member holding and conveying a material to be conveyed, in cooperation with the roll portions so that the material to be conveyed is discharged onto a discharge section; and a protrusion formed on an outer periphery of the rotating shaft, the entire body of the protrusion not protruding beyond the outer diameter of the roll portions, wherein the protrusion includes at least one curved surface that extends from and is directly connected to the outer periphery of the rotating shaft to meet a corner portion of the protrusion.

2. The discharge mechanism of claim 1, wherein the protrusion is disposed between the plurality of roll portions.

3. The discharge mechanism of claim 1, wherein n of the protrusions are formed on the rotating shaft along the peripheral direction of the rotating shaft and at positions in the axial direction at which the protrusions overlap each other, and the rotating shaft is rotated at least 1/n turns during a time period from when the roll portions discharge the material to be conveyed to the discharge section to when a subsequent material to be conveyed reaches the roll portions.

4. The discharge mechanism of claim 3, wherein the rotating shaft is rotated at least 1/n turns within a period of time, which is the sum of the time from when the roll portions discharge the material to be conveyed to the discharge section to when the rotation of the rotating shaft is stopped, and the time from when the rotating shaft, the rotation of which has been stopped, is rotated again and to when a subsequent material to be conveyed reaches the roll portions.

5. The discharge mechanism of claim 1, wherein the plurality of roll portions are formed in the shape of a ring.

6. An image forming device comprising:

an image forming section that forms an image on a recording surface of a recording medium which is a material to be conveyed; and the discharge mechanism of claim 1 that discharges the recording medium onto the discharge section with the recording surface facing toward the rotating shaft.

7. The discharge mechanism of claim 1, wherein the protrusion has a first surface and a second surface, the first surface facing toward the direction in which the rotating shaft is rotated when the material to be conveyed is discharged and extending in a substantially radial direction of the rotating shaft, the second surface being formed opposite to the first surface so as to gradually approach the first surface as the second surface extends toward an outer side of the rotating shaft in the radial direction.

8. The discharge mechanism of claim 1, wherein a plurality of the protrusions are formed at different positions of the rotating shaft in the axial direction and a peripheral direction thereof.

9. The discharge mechanism of claim 1, wherein the rotating shaft has a curved outer peripheral surface, and the protrusion is formed on the curved outer peripheral surface.

* * * * *